United States Patent [19]

Prough et al.

[11] Patent Number: 4,577,974

[45] Date of Patent: Mar. 25, 1986

[54] MEDIUM CONSISTENCY MIXER ROTOR AND STATOR CONSTRUCTION

[75] Inventors: J. Robert Prough; Louis O. Torregrossa, both of Glens Falls, N.Y.

[73] Assignee: Kamyr, Inc., Glens Falls, N.Y.

[21] Appl. No.: 607,309

[22] Filed: May 4, 1984

[51] Int. Cl.[4] ..... B01F 7/02

[52] U.S. Cl. ..... 366/307; 241/28; 241/46.11

[58] Field of Search ..... 366/279, 307, 325; 162/57, 243, 261; 241/28, 46.11, 46.17

[56] References Cited

U.S. PATENT DOCUMENTS

| | | | |
|---|---|---|---|
| 271,242 | 1/1883 | Hobbs | 366/307 |
| 922,076 | 5/1909 | Beemer | 366/307 X |
| 2,260,198 | 10/1941 | Smith | 241/28 |
| 2,937,857 | 5/1960 | Thurman | 366/307 X |
| 3,307,919 | 3/1967 | McCleary et al. | 366/325 X |
| 3,877,648 | 4/1975 | Vokes | 162/261 X |
| 4,339,206 | 7/1982 | Ahs | 366/307 |

FOREIGN PATENT DOCUMENTS 1102604 6/1981 Canada .

OTHER PUBLICATIONS

International Technology Disclosures, vol. 1, No. 9, pp. 3 and 4, "Mixing Steam and/or Chemicals Into a Fiber Suspension", Jul. 25, 1983.

*Primary Examiner*—Philip R. Coe

*Attorney, Agent, or Firm*—Cushman, Darby & Cushman

[57] ABSTRACT

A mixer apparatus, and procedure, for mixing medium consistency (e.g., 6–15%) paper pulp, or like fibrous suspension, minimizes the power necessary to effect fluidization, and minimizes the speed for rotation of the rotor to effect fluidization. This is accomplished by preventing the formation of a shadow behind the rotor ribs as they rotate within the mixer housing, and similarly by preventing the formation of a shadow behind the stationary ribs formed on the housing (and cooperating with the rotating ribs). Such shadows are prevented by providing one wall of each of the ribs—the trailing wall in the direction of rotation of the rotor—so that it is sloped, and fills the volume the shadow would occupy.

11 Claims, 3 Drawing Figures

MEDIUM CONSISTENCY MIXER ROTOR AND STATOR CONSTRUCTION

BACKGROUND AND SUMMARY OF THE INVENTION

In the treatment of fiber suspensions, particularly comminuted cellulosic fibrous suspensions (such as paper pulp), it is desirable to be able to effect mixing of treatment fluids with the suspension at "medium" consistency, which is approximately the consistency from the digester. Typically, the consistency range will be about 6–15%. If mixing can effectively be accomplished at such consistency, there is no need for complicated apparatus and procedures for diluting, and then rethickening, the suspension.

Typical apparatus for effecting mixing of treatment fluids with suspensions—such as shown in Canadian Pat. No. 1,102,604—includes a rotor mounted for rotation with a rotatable shaft which extends along the centerline of a first diameter portion of a housing, through which the suspension passes. The rotor includes a plurality of generally axially extending, radially upstanding, ribs, and preferably the inner wall of the housing includes stationary ribs that are also axially extending, and are generally radially inwardly directed, and radially spaced from the rotor ribs. The rotor is rotated at an RPM sufficient to effect fluidization of the suspension, so that when the treatment fluid is introduced appropriate intermixing is achieved despite the fact that the suspension is at a consistency of about 6–15%.

While some conventional mixers utilizable with medium consistency pulp effectively accomplish their objectives, intermixing is sometimes accomplished only at a higher RPM than desired, and with consumption of more power than desired. It has been found, according to the present invention, that unnecessarily high RPMs and power consumption can occur as a result of a "shadow" being formed behind the rotor ribs and/or stationary ribs, as the rotor rotates within the suspension. Under some circumstances, a plug of suspension can actually result, and this plug can remain intact and actually "leak" through the entire mixing zone without being fluidized, and intermixed with the treatment chemical.

According to the present invention, a means is provided for eliminating the "shadow" formed behind the rotor and stationary ribs, so as to ensure efficient transmittal of the energy of rotation of the rotor to the areas behind the ribs (in the direction of rotation of the rotor) so that power consumption is minimized, and so that the rotor can rotate at a minimum RPM while still effectively accomplishing fluidization of the suspension, and intermixing of the suspension with treatment fluid. Elimination of the shadow is accomplished by forming the rotor ribs so that each has a first side wall that is generally radially extending, a generally flat top, and a second side wall, opposite the first side wall, that is generally at a tangent to the rotor surface. The first side wall of each rotor rib is closest to the second side wall of the circumferentially adjacent rotor rib, and vice versa. The rotor is rotated in a direction of rotation such that the second side wall of each rib is the "trailing" wall.

The desired results according to the present invention are also accomplished by forming the stationary ribs so that the second wall thereof is a wall that slopes from the generally flat top of the rib to the inner wall of the housing, occupying the volume where the "shadow" would normally form during rotation of the rotor with respect to the stationary ribs.

It is the primary object of the present invention to provide a mixing apparatus, and mixing method, that minimize power consumption and rotor RPM during the effective treatment of medium consistency fibrous suspension with treatment fluid. This and other objects of the invention will become clear from an inspection of the detailed description of the invention, and from the appended claims.

DETAILED DESCRIPTION OF THE DRAWINGS

1. Prior Art

Figure 1:
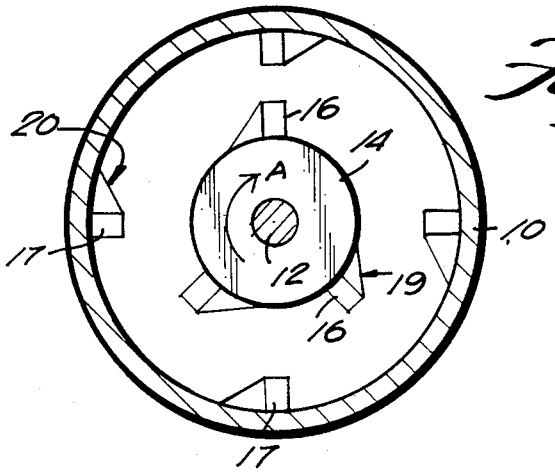
Fig. 1 PRIOR ART
FIG. 1 is an end cross-sectional view of an exemplary conventional medium consistency suspension mixing apparatus.

A conventional mixer for mixing medium consistency (e.g., 6–15%) fibrous suspensions with a treatment fluid, is illustrated schematically in FIG. 1. Such a mixer, which may be of any one of the types as shown in Canadian Pat. No. 1,102,604, includes a housing 10 with a suspension inlet thereto, and a suspension outlet therefrom (not shown), and with a rotatable shaft 12 disposed generally along the central axis of the housing 10. A rotor 14 rotates with the shaft 12, and includes a plurality of ribs 16. The ribs are generally axially extending, and generally radially upstanding from the surface of the rotor 14. There also desirably are provided stationary ribs 17 that are also generally axially extending, and extend radially inwardly from the inner surface of the housing 10, the ribs 16, 17 being radially spaced from each other.

During operation of the mixer of FIG. 1, the rotor 14 is rotated so that it effects fluidization of the suspension within the housing 10. However, a drawback associated with the mixer of FIG. 1 is that as the ribs 16 pass through the suspension in the direction of rotation A of the rotor 14, a shadow—shown generally by reference numeral 19 in FIG. 1—is formed behind (i.e., at the trailing side wall of) each rib 16. This shadow comprises an area of suspension that may not be fluidized by the rotor 14 since energy is not transmitted efficiently into the shadows 19. Thus, a much higher RPM of the rotor 14 than is desired is required to fluidize the shadow areas 19, and since the bulk of the material is thus at an unnecessarily high RPM, power consumption is greater than desired. In fact, total fluidization may not occur at all under some circumstances, so that a plug of suspension can "leak" through the mixing zone without ever being fluidized or intermixed with treatment fluid.

Note that a similar shadow 20 is formed associated with each stationary rib 17, again at the trailing side wall of each rib 17 in the direction of rotation A of the rotor 14.

2. Apparatus of the Invention

Figure 2:
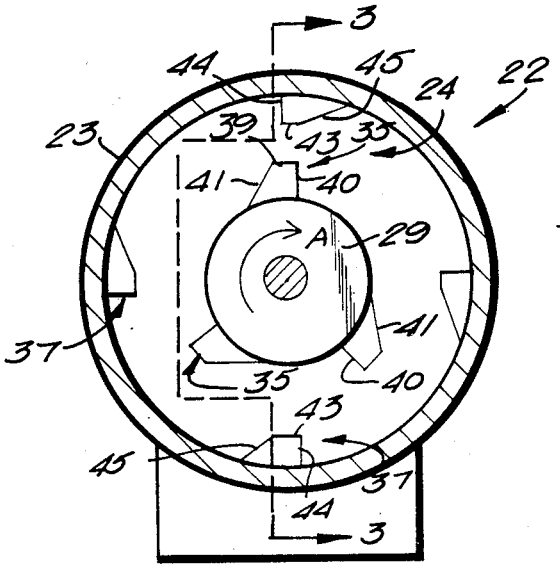
FIG. 2 is an end cross-sectional view, like that of FIG. 1, only showing an exemplary apparatus according to the present invention, FIG. 2 being taken along lines 2—2 of FIG. 3.
Figure 3:
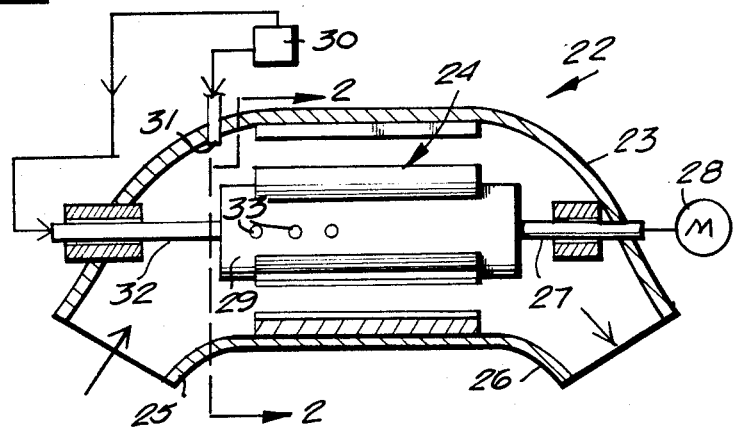
FIG. 3 is a side view, partly in cross-section and partly in elevation, of the apparatus of FIG. 2, and taken along lines 3—3 thereof.

According to the present invention, an exemplary embodiment of which is illustrated in FIGS. 2 and 3, apparatus is provided which eliminates the problems associated with the "shadow" formation of the prior art as illustrated in FIG. 1.

An exemplary apparatus for mixing a fibrous suspension with treatment fluid according to the present invention is shown generally by reference numeral 22 in FIGS. 2 and 3. The apparatus 22 comprises the conventional components of a housing 23 having a first diameter circular portion—shown generally by reference numeral 24—thereof, and having a suspension inlet 25 and a suspension outlet 26. Of course, the housing 23 is not restricted to the particular configuration illustrated in FIGS. 2 and 3, but can assume any conventional configuration, a number of which are shown in Canadian Pat. No. 1,102,604.

Mounted within the housing 23 is a rotatable shaft 27, which is rotatable about an axis which essentially extends along the centerline of the housing portion 24. A motor 18 effects rotation of the shaft 27 and the rotor 29 integral therewith. The motor 18 effects rotation of the rotor 29 so that fluidization of suspension within the housing portion 24 takes place.

Treatment fluid, such as steam, chlorine gas, or chlorine in solution, is introduced into the housing 23 adjacent the rotor 29. For instance, treatment fluid can be introduced from source 30, through nozzle 31, or through a hollow portion 32 of shaft 27, and ultimately through openings 33 in rotor 29. A wide variety of other mechanisms for introducing the treatment fluid also may be provided, again such as shown in Canadian Pat. No. 1,102,604.

Distinguishing features of the apparatus 22 according to the present invention are the particular constructions of the rotor ribs 35 and/or the stationary ribs 37.

The rotor ribs 35 are constructed so as to comprise means for preventing formation of a shadow behind each rib as it rotates in the direction of rotation A. This is preferably accomplished by constructing each rib 35 so that it has a generally flat top portion 39, a first side wall 40, which side wall is generally (but not by any means necessarily exactly) radially extending, and a second side wall 41 opposite the first side wall 40. The second side wall 41 is disposed generally at a tangent to the surface of the rotor 29. However, it is by no means necessary to make the second side wall 41 exactly tangent to the surface of the rotor 29, the only requirement for the second side wall 41 being that it cooperates with the rest of the components of each rib 35 so as to occupy a majority of the volume behind each rib 35 where a "shadow" would normally be formed.

Preferably each of the stationary ribs 37 is also formed in such a way as to comprise means for preventing formation of a shadow behind each of the ribs 37 in the direction of rotation A of the rotor 29. This is accomplished by constructing each of the ribs 37 so that it has a generally flat top 43, a generally radially inwardly extending first side wall 44, and a second side wall 45, opposite the side wall 44. The second side wall has a gradual slope from the rib top 43 to the interior of the housing 23, again to occupy what would normally be the "shadow" volume.

As clearly seen in FIG. 2, the first wall 40 of each rotor rib 35 is closest to the second wall 41 of the circumferentially adjacent rib 35, and vice versa. This is also true for the stationary ribs 37. Also, the stationary ribs 37 are disposed vis-a-vis the rotor ribs 37 so that when the generally flat surfaces 39, 43 of a pair of ribs 35, 37 are in radial alignment (as for the top ribs 37, 35 in FIG. 2), the first side wall 44 of the rib 37 will be in alignment with (e.g., overlie) the second side wall 41 of the rib 35, and the second side wall 45 of the rib 37 will be in alignment with (e.g., overlie) the first side wall 40 of the rib 35.

A wide variety of different numbers of stationary and rotor ribs may be provided for the apparatus 22. In a preferred embodiment illustrated in the drawings, the rotor 29 has three rotor ribs 35, while four stationary ribs 37 are provided with the housing 23.

The ribs 35, 37 can initially be constructed with the configurations illustrated in FIGS. 2 and 3, or inserts can be attached to pre-existing ribs (such as the ribs 16, 17) in conventional mixers such as illustrated in FIG. 1. For instance, pieces of metal in the shape of triangular prisms, having the same axial length as the ribs 16, 17, can be welded, or otherwise attached, to the appropriate side face of each of the ribs 16, 17, and may also be similarly attached to the rotor 14 circumference or the interior surface of the housing 10.

3. Method

In the practice of the method according to the present invention, treatment fluid—such as steam, chlorine gas, or chlorine in solution—is mixed into a comminuted cellulosic fibrous suspension having a consistency of about 6–15% (preferably 8–12%) by practicing the following steps:

(a) Feeding the suspension in a first substantially linear direction, from the inlet 25 to the outlet 26 in the generally circularly first diameter portion 24 of the housing 23.

(b) Introducing treatment fluid into the suspension while it is flowing in the first direction, as by passing the treatment fluid from reservoir 30 through nozzle 31 and/or through hollow shaft 32 so that the treatment fluid is introduced into the housing portion 24 adjacent the rotor 29. And (c) effecting fluidization of the suspension when flowing in the first direction by rotating the shaft 27 at high RPM utilizing the motor 28, so that the treatment fluid become intimately intermixed with the suspension while it is flowing in the housing portion 24.

According to the present invention, step (c) is practiced by providing the construction of the rotor ribs 35, and stationary ribs 37, described above—and illustrated in FIGS. 2 and 3—so that shadows do not form behind the rotor ribs 35 and/or the stationary ribs 37, so that power consumption is minimized, and the rotor 29 may be rotated at minimum RPM while effectively accomplishing fluidization and intermixing.

It will thus be seen that according to the present invention a method and apparatus have been provided for minimizing power consumption while effecting mixing of a treatment fluid with a medium consistency suspension.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for continuously mixing fluid into a fibrous suspension, comprising:

a housing having a first, generally circular cross-section portion, with an inlet to, and an outlet from, said housing;

a shaft mounted for rotation within said housing substantially along the center of the first portion thereof;

a rotor rotatable with said shaft, including a plurality of fluidizing axially extending, and radially upstanding ribs, said rotor, including said ribs, having a diameter smaller than said housing first portion diameter;

means for introducing fluid into fibrous suspension within said housing, adjacent said rotor;

means for effecting rotation of said shaft about said axis to effect fluidization of suspension acted upon by said rotor;

wherein each of said ribs comprises a first, generally radially extending, side wall; a second side wall being generally tangent to said rotor, and being disposed on the opposite side of said rib as said first wall; and a substantially flat top; and wherein said first side of each rib is closest to the second side of a circumferentially adjacent rib, and vice versa;

a plurality of axially extending, radially inwardly extending stationary ribs formed on the inner surface of said housing at said first portion of said housing, said stationary ribs being radially spaced from said rotor ribs; and wherein each of said stationary ribs comprises: a generally flat radially innermost surface; a first, generally radially extending, side wall; and a second side wall, opposite said first side wall, said second side wall sloping gradually from said rib top to an inner surface of said housing; and wherein said first side wall of each of said stationary ribs is closest to the second side wall of a circumferentially adjacent stationary rib, and vice versa; and wherein when a rib of said rotor is in radial alignment with one of said stationary ribs, said first side wall of said rotor rib is in alignment with said second side wall of said stationary rib, and said second side wall of said rotor rib is in alignment with said first side wall of said stationary rib.

2. Apparatus as recited in claim 1 wherein said plurality of rotor ribs consists of three ribs.

3. Apparatus as recited in claim 2 wherein said plurality of stationary ribs consists of four ribs.

4. Apparatus for continuously mixing fluid into a fibrous suspension, comprising:

a housing having a first, generally circular cross-section portion, with an inlet to, and an outlet from, said housing;

a shaft mounted for rotation within said housing substantially along the center of the first portion thereof;

a rotor rotatable with said shaft, including a plurality of fluidizing axially extending, and radially upstanding ribs, said rotor, including said ribs, having a diameter smaller than said housing first portion diameter;

means for introducing fluid into fibrous suspension within said housing, adjacent said rotor;

means for effecting rotation of said shaft about said axis to effect fluidization of suspension acted upon by said rotor;

means for preventing formation of a shadow behind each rib in the direction of rotation of the rotor and ribs, so that fluidization can be effected with minimized energy, and with minimized RPM of said rotor, said means for preventing formation of a shadow comprising: each of said ribs comprises: a first, generally radially extending, side wall; a second side wall being generally tangent to said rotor, and being disposed on the opposite side of said rib as said first wall; and a substantially flat top; and wherein said first side of each rib is closest to the second side of a circumferentially adjacent rib, and vice versa;

a plurality of axially extending, radially inwardly extending stationary ribs formed on the inner surface of said housing at said first portion of said housing, said stationary ribs being radially spaced from said rotor ribs; and each of said stationary ribs comprising a generally flat radially innermost surface; a first, generally radially extending, side wall; and a second side wall, opposite said first side wall, said second side wall sloping gradually form said rib top to an inner surface of said housing; and wherein said first side wall of each of said stationary ribs is closest to the second side wall of a circumferentially adjacent stationary rib, and vice versa; and wherein when a rib of said rotor is in radial alignment with one of said stationary ribs, said first side wall of said rotor rib is in alignment with said second side wall of said stationary rib, and said second side wall of said rotor rib is in alignment with said first side wall of said stationary rib.

5. Apparatus as recited in claim 4 wherein said plurality of rotor ribs consists of three ribs.

6. Apparatus as recited in claim 5 wherein said plurality of stationary ribs consists of four ribs.

7. Apparatus for continuously mixing fluid into a fibrous suspension, comprising:

a housing having a first, generally circular cross-section portion, with an inlet to, and an outlet from, said housing;

a shaft mounted for rotation within said housing substantially along the center of the first portion thereof;

a rotor rotatable with said shaft, including a plurality of fluidizing axially extending, and radially upstanding ribs, said rotor, including said ribs, having a diameter smaller than said housing first portion diameter; each rotor rib comprising a first side wall and a second side wall, the first side wall of each rib being closest to the second side wall of an adjacent rotor rib, and vice versa;

means for introducing fluid into fibrous suspension within said housing, adjacent said rotor;

means for effecting rotation of said shaft about said axis to effect fluidization of suspension acted upon by said rotor; and a plurality of generally axially extending, radially inwardly directed stationary ribs formed on the inner surface of said housing at said first portion thereof, said stationary ribs radially spaced from said rotor ribs; and means for preventing formation of a shadow behind each of said stationary ribs as said rotor ribs rotate past said stationary ribs; said means for preventing formation of a shadow behind each of said stationary ribs comprises: each of said stationary ribs comprises: a generally flat radial innermost surface, a first, generally radially extending, side wall; and a second side wall, opposite said first side wall, said second side wall sloping gradually from said rib top to an inner surface of said housing; and wherein said first said wall of each of said stationary ribs is closest to the second side wall of a circumferentially adjacent stationary rib, and vice versa; and wherein when a rib of said rotor is in radial alignment with one of said stationary ribs, said first side wall of said rotor rib is in alignment with said second side wall of said stationary rib, and said second side wall of said rotor rib is in alignment with said first side wall of said stationary rib.

8. Apparatus as recited in claim 7 wherein said plurality of rotor ribs consists of three ribs.

9. Apparatus as recited in claim 8 wherein said plurality of stationary ribs consists of four ribs.

10. Apparatus for continuously mixing fluid into a fibrous suspension, comprising:

a housing having a first, generally circular cross-section portion, with an inlet to, and an outlet from, said housing;

a shaft mounted for rotation within said housing substantially along the center of the first portion thereof;

a rotor rotatable with said shaft, including a plurality of fluidizing axially extending, and radially upstanding ribs, said rotor, including said ribs, having a diameter smaller than said housing first portion diameter;

means for introducing fluid into fibrous suspension within said housing, adjacent said rotor;

wherein each of said ribs comprises a first, generally radially extending, side wall; a second side wall being generally tangent to said rotor, and being disposed on the opposite side of said rib as said first wall, and a substantially flat top;

wherein said first side of each rib is closest to the second side of a circumferentially adjacent rib, and vice versa; and means for effecting rotation of said shaft about said axis in a direction in which said first side walls of said ribs are the leading portions thereof, to effect fluidization of suspension acted upon by said rotor;

a plurality of axially extending, radially inwardly extending stationary ribs formed on the inner surface of said housing at said first portion of said housing, said stationary ribs being radially spaced from said rotor ribs;

wherein each of said stationary ribs comprises: a generally flat radially innermost surface; a first, generally radially extending, side wall; and a second side wall, opposite said first side wall, said second side wall sloping gradually from said rib top to an inner surface of said housing; and wherein said first side wall of each of said stationary ribs is closest to the second side wall of a circumferentially adjacent stationary rib, and vice versa; and wherein when a rib of said rotor is in radial alignment with one of said stationary ribs, said first side wall of said rotor rib is in alignment with said second side wall of said stationary rib, and said second side wall of said rotor rib is in alignment with said first side wall of said stationary rib.

11. Apparatus for continuously mixing fluid into a fibrous suspension, comprising:

a housing having a first, generally circular cross-section portion, with an inlet to, and an outlet from, said housing;

a shaft mounted for rotation within said housing substantially along the center of the first portion thereof;

a rotor rotatable with said shaft, including a plurality of fluidizing axially extending, and radially upstanding ribs, said rotor, including said ribs, having a diameter smaller than said housing first portion diameter;

means for introducing fluid into fibrous suspension within said housing, adjacent said rotor;

means for effecting rotation of said shaft about said axis to effect fluidization of suspension acted upon by said rotor;

means for preventing formation of a shadow behind each rib in the direction of rotation of the rotor and ribs, so that fluidization can be effected with minimized energy, and with minimized RPM of said rotor; said means comprising the construction of said ribs and said means for rotating said shaft, each of said ribs comprising: a first, generally radially extending, side wall; a second side wall being generally tangent to said rotor, and being disposed on the opposite side of said rib as said first wall; and a substantially flat top; and wherein said first side of each rib is closest to the second side of a circumferentially adjacent rib, and vice versa; and wherein said means for effecting rotation of said shaft effects rotation in a direction in which said first side walls of said ribs are the leading portions thereof;

a plurality of axially extending, radially inwardly extending stationary ribs formed on the inner surface of said housing at said first portion of said housing, said stationary ribs being radially spaced from said rotor ribs;

wherein each of said stationary ribs comprises: a generally flat radially innermost surface; a first, generally radially extending, side wall; and a second side wall, opposite said first side wall, said second side wall sloping gradually from said rib top to an inner surface of said housing; and wherein said first side wall of each of said stationary ribs is closest to the second side wall of a circumferentially adjacent stationary rib, and vice versa; and wherein when a rib of said rotor is in radial alignment with one of said stationary ribs, said first side wall of said rotor rib is in alignment with said second side wall of said stationary rib, and said second side wall of said rotor rib is in alignment with said first side wall of said stationary rib.

* * * * *